United States Patent [19]

Klein

[11] 4,316,286

[45] Feb. 23, 1982

[54] BULLETPROOF PROTECTIVE PLATE ASSEMBLY

[76] Inventor: John M. Klein, 1754 Grant, Birmingham, Mich. 48009

[21] Appl. No.: 128,267

[22] Filed: Mar. 7, 1980

[51] Int. Cl.[3] ..... F41H 1/02

[52] U.S. Cl. ..... 2/2.5; 89/36 A; 428/911; 109/49.5

[58] Field of Search ..... 2/25; 89/36 A, 36 D; 428/911

[56] References Cited

U.S. PATENT DOCUMENTS

| | | | |
|---|---|---|---|
| 1,296,113 | 3/1919 | Perlman | 2/2.5 |
| 1,298,618 | 3/1919 | Wloszek | 2/2.5 |
| 1,758,296 | 5/1930 | Schaumann | 2/2.5 X |
| 2,723,214 | 11/1955 | Meyer | 2/2.5 X |
| 2,748,391 | 6/1956 | Lewis et al. | 2/2.5 |
| 2,771,384 | 11/1956 | Collins | 2/2.5 X |
| 3,783,449 | 1/1974 | Davis | 2/2.5 |
| 3,829,899 | 8/1974 | Davis | 2/2.5 |
| 4,241,457 | 12/1980 | Klein et al. | 2/2.5 |

FOREIGN PATENT DOCUMENTS

| | | | |
|---|---|---|---|
| 2162701 | 6/1971 | Fed. Rep. of Germany | 2/2.5 |
| 2344222 | 6/1974 | Fed. Rep. of Germany | 2/2.5 |
| 2826236 | 12/1979 | Fed. Rep. of Germany | 2/2.5 |
| 2431674 | 3/1980 | France | 2/2.5 |

*Primary Examiner*—Louis Rimrodt
*Attorney, Agent, or Firm*—Basile, Weintraub & Hanlon

[57] ABSTRACT

A bulletproof protective plate assembly suitable for use as bulletproof armor. The protective plate assembly includes a plurality of first plates arranged in vertical edge-to-edge relationship. The first plates are formed with contiguous first and second portions, with the second portion disposed at a predetermined angle with respect to the first portion such that the first plates closely conform to the shape of the upper torso of a human being along the vertical plane when the protective plate assembly is applied thereto. One of the lateral edges of the second portion of certain of the first plates is notched or disposed at an obtuse angle with the corresponding contiguous edge of the first portion of the first plate so as to enable the first plates to flex or hinge about the adjoining vertical edges without the edges of the second portions of each plate abutting to thereby closely conform the protective plate assembly to the body of the wearer along the horizontal plane. A plurality of second plates are disposed over the joints between adjoining edges of the first plates. The first and second plates are contained in the desired position within an enclosure that is inserted into a cavity in a conventional bulletproof vest or can be used with an identically formed protective plate assembly and connecting straps to protect both the front and back of the wearer.

9 Claims, 7 Drawing Figures

BULLETPROOF PROTECTIVE PLATE ASSEMBLY

BACKGROUND OF THE INVENTION

1. Field of the Invention

This invention relates, in general, to protective garments and, more specifically, to protective garments worn by an individual to absorb the impact and stop a projectile from penetrating the body of the wearer.

2. Description of the Prior Art

Bulletproof protective garments or armor are well known for personal use by human beings to prevent a projectile from penetrating the body of an individual. Such garments are typically made from a plurality of plates formed of metallic or other suitable material which are fastened together in some manner to fit around the body of the wearer and in particular his upper torso.

Examples of such known bulletproof garments include those disclosed in U.S. Pat. Nos. 3,787,449 and 3,829,899, both of which disclose protective armor in the form of a vest made of sheets of heavy gauge material. A pocket is formed in the sheets to removably receive a metal insert plate to increase the protective capabilities of the armor. The insert plate is formed of a number of edge-to-edge aligned plates disposed in two vertically extending rows with the joints between the plates covered by a series of third plates. Such an arrangement makes the metal insert plate flexible enough to bend transversely to the plane of the joints so as to fit about the body of the wearer in a vertical plane.

Another form of bullet proof armor is shown in U.S. Pat. No. 2,723,214. This bulletproof armor construction comprises a plurality of alternating layers of rigid plates and elastic material. Each layer of plate is formed of a plurality of individual segments with joints between the segments offset from layer to layer.

These patents show that it is well known to form bulletproof armor with flexible plates which flex or hinge to conform to the curvature of the torso of the wearer along one plane, i.e. up and down. However, problems still exist with their use as regarding the mobility of the individual wearing the bulletproof armor. The prior art uses rigid plates arranged for flexing or hinging along one plane so as to conform to the body of the wearer along that particular plane. However, the torso of a human being curves in both the vertical and horizontal planes. Thus, the provision of rigid plates that can flex along only one plane does nothing for conforming the shape of the bulletproof vest or armor to the shape of the human torso along the other plane, i.e. from side-to-side. The plates along this other plane are rigid and extend substantially straight along the vest which reduces the mobility of the individual wearing the protective garment since the garment does not closely conform to the shape of the human being along this plane. In addition, such a bulletproof armor construction fails to provide for a close fit for a wide variety of different sized wearers.

Thus, it would be desirable to provide a protective plate assembly for individual use which overcomes the problems associated with prior art bulletproof protective garments and armor. It would also be desirable to provide a protective plate assembly which conforms to the shape of the upper torso of a human being along both the horizontal and vertical planes. Finally, it would be desirable to provide a protective plate assembly which does not hinder the movement of the wearer so as to provide increased mobility therefore.

SUMMARY OF THE INVENTION

There is disclosed herein an individual bulletproof protective plate assembly for use as bulletproof armor. The protective plate assembly comprises a plurality of suitably formed plates which may be inserted into a cavity in a conventional bulletproof vest or may be used with an identically shaped protective plate assembly and interconnecting straps to fit over the upper torso of the wearer to protect both the front and back of the wearer. The protective plate assembly includes a plurality of first plates which are disposed within an enclosure. The first plates are arranged in vertical edge-to-edge relationship and are interconnected to form a unitary structure that can flex or hinge along the adjoining edges of the first plates. The first plates are formed with contiguous first and second portions, with the second portion being disposed at an obtuse angle with respect to the first portion such that the first plates closely conform to the shape of the upper torso of a human being along a vertical plane. One of the edges of certain of the second portions of adjacent first plates is notched or cut at an obtuse angle with respect to the contiguous edge of the first portion of the first plate such that the edges of the second plates can flex or hinge upon placing the protective plate assembly on the individual wearer. A plurality of second plates are respectively disposed over the joints between adjacent edges of the first plates to provide increased protection for the wearer along these joints.

The unique construction of the protective plate assembly of this invention enables the protective plate assembly to closely conform to the shape of the upper torso of a human being along both the vertical and horizontal planes. By disposing the upper portion of the first plates at a predetermined angle with respect to the remaining or cover portion of the first plates, the first plates closely conform to the shape of the upper torso of a human being along the vertical plane. Further, since the first plates are interconnected so as to flex or hinge along the adjoining edges thereof and, further, since one of the edges of the second portion of each first plate is notched or cut at a predetermined angle with respect to the continuous edge of the first portion of each first plate, the first plates are free to hinge about the adjoining edges without the edges of the second portions abutting as would be normally the case if the edges of the second portion of each plate were in the same plane or linear with the edges of the first portion. This enables the protective plate assembly to closely conform to the shape of the upper torso of a human being along the horizontal plane as well.

By providing a closely fitting protective garment, the protective plate assembly of the present invention provides increased mobility for the wearer since the garment essentially becomes an integral part of his body. This unique construction overcomes the problems of prior art bulletproof vests and armor which provide flexure of the plates forming the vest along only one plane with the result that the other plane of the plates is substantially flat and therefore extends out away from the body of the wearer and hampers his subsequent movements.

BRIEF DESCRIPTION OF THE DRAWING

The various features, advantages and other uses of this invention will become more apparent by referring to the following detailed description and drawing in which.

DESCRIPTION OF THE PREFERRED EMBODIMENT

Figure 1:
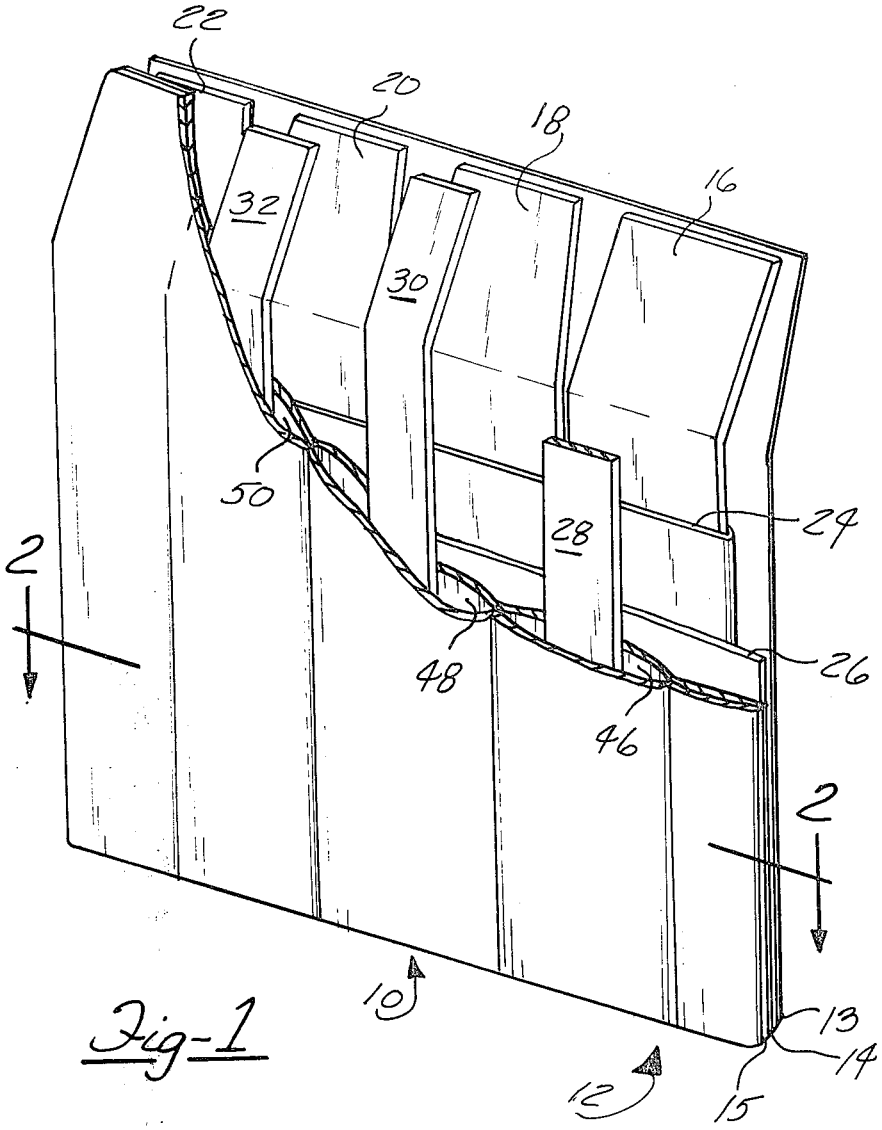
FIG. 1 is a perspective view of a protective plate assembly constructed according to the teachings of this invention.

Throughout the following description and drawing, identical reference numbers are used to refer to the same component shown in multiple figures of the drawing.

Referring now to the drawing, and to FIG. 1 in particular, there is shown bulletproof protective plate assembly 10 suitable for use as bulletproof armor for individuals. According to the preferred embodiment, the protective plate assembly 10 comprises an enclosure 12 formed of a plurality of layers 13, 14 and 15 of a flexible material which are secured or fastened together such as by stitching the layers 13, 14 and 15 of material together along their edges. The protective plate assembly 10 further includes a plurality of first plates 16, 18, 20 and 22 which are disposed in a substantially vertical orientation within the enclosure 12. The first plates 16, 18, 20 and 22 are held in the desired orientation by suitable interconnecting means 24 which is wrapped around or applied by adhesive means to the exterior of the first plates 16, 18, 20 and 22. A layer 26 of a fragmentation suppression material is provided adjacent to the first plates 16, 18, 20 and 22 to collect the fragments of any projectile striking the protective plate assembly 10.

The protective plate assembly 10 further includes a plurality of second plates 28, 30 and 32 which are likewise disposed in a substantially vertical orientation over the adjoining edges of the first plates 16, 18, 20 and 22. An outer layer 15 of material is disposed over the second plates 28, 30 and 32 and secured thereto to maintain the second plates 28, 30 and 32 in the desired position. In addition, as shown in greater detail in FIG. 2, a plurality of layers 34 of a suitable projectile stopping material may be added between the first plates 16, 18,20 and 22 and the innermost layer 13 of material forming the enclosure 12 to provide further projectile stopping properties for the protective plate assembly.

Figure 2:
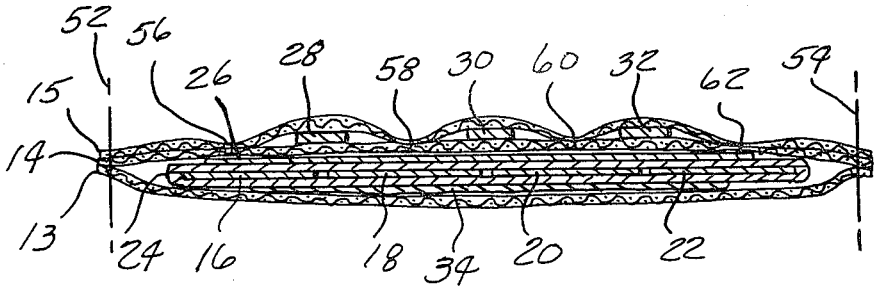
FIG. 2 is a cross sectional view, generally taken along line 2—2 of FIG. 1.
Figure 3:
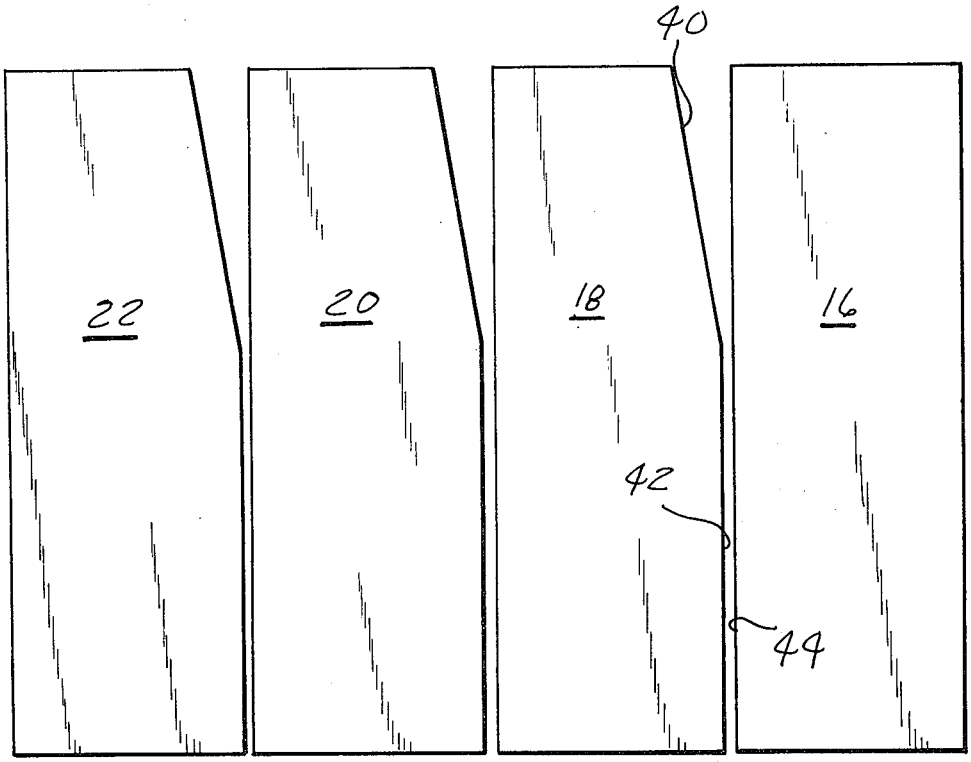
FIG. 3 is a plan view of the first plates of the protective plate assembly of this invention shown in FIG. 1.
Figure 4:
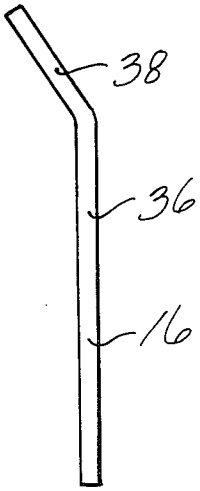
FIG. 4 is a side view of one of the first plates shown in FIG. 3.

Referring now to FIGS. 2, 3 and 4 in conjunction with FIG. 1, further details of the construction of the protective plate assembly 10 of this invention will now be described. As described above, the protective plate assembly 10 includes a plurality of first plates 16, 18, 20 and 22. The first plates are formed of a suitable high impact strength material which can be either a metallic material, such as steel, or any other non-metallic material having sufficient strength and hardness to prevent a projectile from penetrating therethrough.The exact shape and form of the first plates 16, 18, 20 and 22 is shown more clearly in FIGS. 3 and 4.

As shown therein, each of the first plates 16, 18, 20 and 22 has major and minor dimensions. Further, each of the first plates has first and second contiguous portions 36 and 38, respectively, as shown in FIG. 4. The second portion 38 of each of the first plates 16, 18, 20 and 22 is bent or disposed in angular relationship with respect to the first portion 36 so as to closely resemble the shape of the upper torso of a human being such that protective plate assembly 10 and the first plates 16, 18, 20 and 22 contained therein will closely conform to the shape of the upper torso of the human being along the vertical plane when the protective plate assembly 10 is secured around the body of the wearer.

As shown in FIG. 3, one of the edges of certain of the second portion of the first plates, such as edge 40 of the first plate 18, is notched so as to be disposed at an obtuse angle with respect to the contiguous edge 42 of the first portion of the first plate 18. This enables the first plates 16, 18, 20 and 22 to flex or hinge about their adjoining edges, as will be described in greater detail hereafter, without the adjoining edges of the second portions of each of the first plates abutting.

As further shown in FIG. 3, the first plates 16, 18, 20 and 22 are disposed in edge-to-edge relationship such that the major or longest dimension of each of the first plates is disposed in a substantially vertical orientation when the protective plate assembly 10 is applied to the body of the wearer. As shown in FIG. 1, means 24 for flexibly interconnecting the first plates 16, 18, 20 and 22 is provided to join the first plates together in a unitary assembly. The interconnecting means 24, according to the preferred embodiment of this invention, is a high tensile strength fibrous material which is wrapped around the first portion of each of the first plates 16, 18, 20 and 22. The interconnecting means may also comprise a high tensile strength fibrous sheet material which is secured by a suitable adhesive to one side of the first plates 16, 18, 20 and 22. The interconnecting means 24 holds the first plates 16, 18, 20 and 22 in the desired orientation but, at the same time, allows each of the plates 16, 18, 20 and 22 to flex or hinge about their adjoining edges, such as edges 42 and 44 of the first plates 18 and 16, respectively, shown in FIG. 3, so as to enable the protective plate assembly 10 to closely conform to the shape of the upper torso of the wearer along a horizontal plane. During this flexing or hinging, the edges of the second portion of each of the first plates 16, 18, 20 and 22 move into closer proximity. However, the notch, such as notch 40 formed in the second portion of the first plate 18, prevents such second portion edges from abutting and thereby hindering further flexure of the first plates as would commonly occur without the provision of the notch 40.

Figure 5:
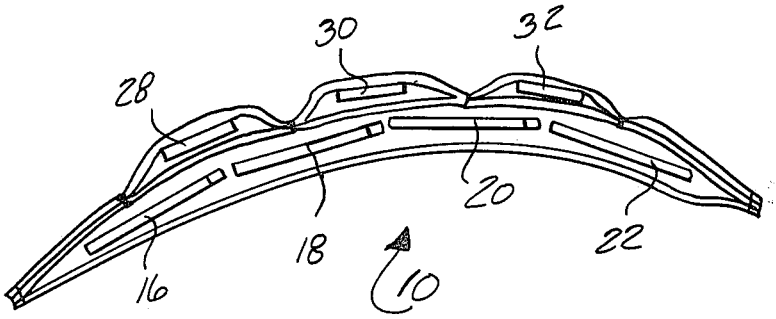
FIG. 5 is a cross sectional view similar to that shown in FIG. 2 but showing the relationship of components of the protective plate assembly of this invention when the protective plate assembly is applied to the body of the wearer.

Thus, the disposition of the second portion of each of the first plates at a predetermined angle with respect to the contiguous edge of the first portion thereof and the interconnecting of the first plates for flexure or hinging about their adjoining edges enables the protective plate assembly 10 of this invention to closely conform to the shape of the upper torso of a human being in both the vertical and horizontal planes as shown more clearly in FIG. 5. FIG. 5 depicts the position the components of the protective plate assembly 10 of this invention assume when the protective plate assembly 10 is secured around the upper torso of the wearer. This clearly illustrates the capability of the assembly 10 to conform to the shape of the torso of the wearer along the horizontal plane.

Referring again to FIGS. 1 and 2, additional components used to form the protective plate assembly 10 of this invention will now be described. As shown therein, a plurality of second plates 28, 30 and 32 are positioned within the enclosure 12. The second plates 28, 30 and 32 are formed preferably of the same material as the first plates, which can be any suitable metallic or non-metallic material having the requisite high tensile strength and hardness to prevent penetration of a projectile therethrough. In addition, the second plates 28, 30 and 32 have substantially the same shape as the first plates, with the upper or second portion thereof disposed in angular relationship with respect to the first portion. However, the second plates 28, 30 and 32 have a substantially smaller width than the first plates. The second plates 28, 30 and 32 have a predetermined length so as to extend along the entire length of the first plates 16, 18, 20 and 22.

The second plates 28, 30 and 32 are disposed over the joints formed between adjoining edges of the first plates 16, 18, 20 and 22 to provide protection along these areas of the protective plate assembly 10. Most importantly, the upper or second portions of each of the second plates 28, 30 and 32 provide protection for the area between the notched or angled second portions of the first plates 16, 18, 20 and 22 when the first plates are not brought into abutting relationship as would be the case when the protective plate assembly 10 is applied to a large sized individual. According to the preferred embodiment of this invention, the outermost layer 15 of material forming the enclosure 12 is suitably joined, such as by stitching, to the intermediate layer 14 of material so as to form a plurality of vertically extending pockets or cavities 46, 48 and 50 within the enclosure 12. The second plates 28, 30 and 32 are then removably received within the internal pockets 46, 48 and 50, respectively.

As noted above, the protective plate assembly 10 contains an intermediate layer 14 of material which forms a part of the enclosure 12. The intermediate and rearmost layers 14 and 13 of material are formed by folding a suitably shaped piece of material in half and stitching the open ends thereof together to form a cavity wherein the first plates 16, 18, 20 and 22 are disposed. In addition, a layer 26 of a fragmentation suppression material is disposed in registry with the first plates 16, 18, 20 and 22 with the cavity. This fragmentation suppression material may be of any suitable type such as a treated nylon which is manufactured into the form of a webbing. This material functions to collect the fragments of any projectile striking the protective plate assembly 10 so as to prevent the fragments from ricocheting off the first plates 16, 18, 20 and 22 and striking the head or other extremities of the wearer of the protective assembly 10. As noted previously, the layers 13, 14 and 15 of material forming the enclosure 12 are joined together to form a complete enclosure 12. As shown in FIG. 2, the layers 13, 14 and 15 of material are joined together along their outermost edges, such as at 52 and 54. Further, as noted above, the outermost and intermediate layers 15 and 14 of material are secured together, such as at locations 56, 58, 60 and 62 to form the internal pockets 46, 48 and 50 for receiving the second plates 28, 30 and 32 therein respectively.

As shown in FIG. 2, the protective plate assembly 10 of this invention may further include a plurality of layers 34 of additional high impact strength material, such as one sold commercially under the tradename "Kevlar", which is disposed between the first plates 16, 18, 20 and 22 and the rearmost layer 13 of material forming the enclosure 12. These additional layers 34 of material function to provide additional penetration resistance for the protective plate assembly 10 to assure that any projectile striking the protective plate assembly 10 does not penetrate completely therethrough.

Figure 6:
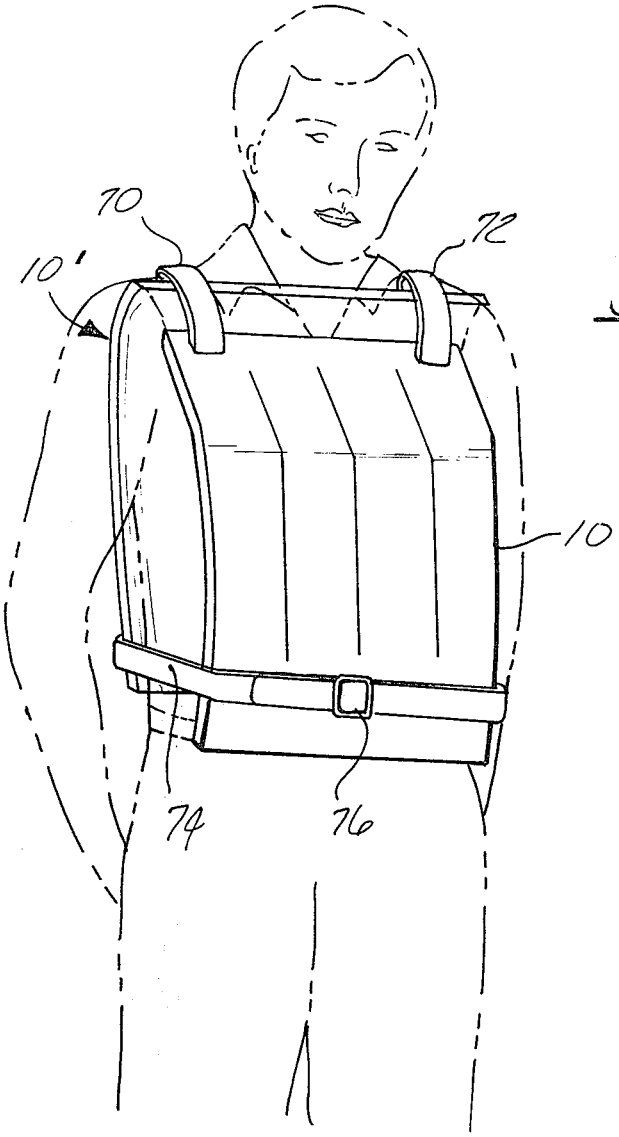
FIG. 6 is a perspective view of one application of the protective plate assembly of this invention.
Figure 7:
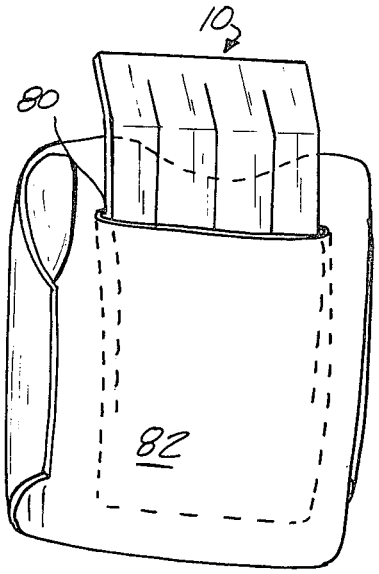
FIG. 7 is a perspective view of another application of protective plate assembly of this invention.

Referring now to FIGS. 6 and 7, there is shown several applications of the protective plate assembly 10 of this invention. As shown in FIG. 6, two identical protective plate assemblies 10 and 10' may be utilized with suitably formed shoulder straps 70 and 72 and a waist strap 74 having a conventional fastening means 76, such as a buckle or the more commonly used "Velcro" type of fastener, to secure both protective plate assemblies 10 and 10' around the front and back of an individual. Such a construction provides protection for both the front and back of the wearer.

The protective plate assembly 10 may also be used as an insert within a conventional bulletproof vest, as shown in FIG. 7. In this application, the protective plate assembly 10 of this invention is removably received with the internal cavity 80 formed in the conventional bulletproof vest 82.

There has been disclosed herein a protective plate assembly suitable for use as bulletproof armor. The protective plate assembly includes a plurality of first plates arranged in vertical edge-to-edge relationship. The first plates are formed with contiguous first and second portions, with the second portions disposed at a predetermined angle with respect to the first portions such that the first plates closely conform to the shape of the upper torso of a human being. One of the edges of the second portions of certain of the first plates is notched or disposed at a predetermined obtuse angle with respect to the contiguous edge of the first portion of the first plate such that the edges of the second portions of the first plates do not abut when the first plates are flexed or hinged about their adjoining edges to conform the protective plate assembly to the shape of the upper torso of the wearer. In this manner, the protective plate assembly of this invention closely conforms to the shape of the upper torso of the human being in both the vertical and horizontal planes which increases the mobility of the wearer.

What is claimed is:

1. A protective plate assembly comprising:

a plurality of first plates having contiguous first and second portions, said second portion being disposed at a predetermined angle with respect to said first portion such that said first plates closely conform to the shape of the torso of a human being along the vertical plane of the body of the wearer;

said first portions of said first plates being disposed in edge-to-edge relationship in a common plane;

certain of said second portions of said first plates having at least one lateral edge thereof disposed at an obtuse angle with respect to the contiguous edge of said first portion of said plate to permit said first plates to rotate freely about the adjoining edges of said first portions without interference between the edges of said second portions of said first plates such that said protective plate assembly closely conforms to the shape of the body of the wearer along a horizontal plane;

a plurality of second plates disposed in overlapping relationship over the adjoining edges of said first plates; and an enclosure housing said first and second plates and maintaining said first and second plates in the desired position.

2. The protective plate assembly of claim 1 further including means for flexibly interconnecting the first plates in a unitary assembly such that said first plates are free to rotate about their adjoining edges.

3. The protective plate assembly of claim 2 wherein the the interconnecting means is a high tensile strength fibrous material disposed around the first plates.

4. The protective plate assembly of claim 1 wherein the first and second plates are formed of a metallic material.

5. The protective plate assembly of claim 1 wherein the second plates extend along the entire length of the first plates to cover the entire joint area between adjoining edges of said first plates.

6. The protective plate assembly of claim 1 further including a plurality of layers of high impact strength material disposed between the enclosure and the first plates to provide additional penetration withstanding capabilities for said protective plate assembly.

7. The protective plate assembly of claim 1 further including means for securing said protective plate assembly about the body of the wearer.

8. Bulletproof armor comprising:

first and second protective plate assembly respectively secured to the front and back of the wearer, each of said first and second protective plate assembly comprising:

a plurality of first plates having contiguous first and second portions, said second portion being disposed at a predetermined angle with respect to said first portion such that said first plates closely conform to the shape of the torso of a human being along the vertical plane of the body of the wearer;

said first portions of said first plates being disposed in edge-to-edge relationship in a common plane;

certain of said second portions of said first plates having at least one lateral edge thereof disposed at an obtuse angle with respect to the contiguous edge of said first portion of said plate to permit said first plates to rotate freely about the adjoining edges of said first portions without interference between the edges of said portions of said first plates such that said protective plate assembly closely conforms to the shape of the body of the wearer along a vertical plane;

a plurality of second plates disposed in overlapping relationship over the adjoining edges of said first plates; and an enclosure housing said first and second plates and maintaining said first and second plates in the desired position.

9. Bulletproof armor comprising:

an outer housing;

means for securing said housing about the body of a wearer;

said housing including an internal cavity;

a protective plate assembly adapted to be inserted into said internal cavity, said protective plate assembly comprising:

a plurality of first plates having contiguous first and second portions, said second portion being disposed at a predetermined angle with respect to said first portion such that said first plates closely conform to the shape of the torso of a human being along the vertical plane of the body of the wearer;

said first portions of said first plates being disposed in edge-to-edge relationship in a common plane;

certain of said second portions of said first plates having at least one lateral edge thereof disposed at an obtuse angle with respect to the contiguous edge of said first portion of said plate to permit said first plates to rotate freely about the adjoining edges of said first portions without interference between the edges of said second portions of said first plates such that said protective plate assembly closely conforms to the shape of the body of the wearer along a horizontal plane;

a plurality of second plates disposed in overlapping relationship over the adjoining edges of said first plates; and an enclosure housing said first and second plates and maintaining said first and second plates in the desired position.

* * * * *